US008490905B2

(12) United States Patent
Dallimore et al.

(10) Patent No.: US 8,490,905 B2
(45) Date of Patent: Jul. 23, 2013

(54) HORIZONTAL SHAFT IMPACT CRUSHER

(75) Inventors: Rowan Dallimore, St. John (GB); George Fensome, Thornbury (GB); Laurent Tisserand, Bichancourt (FR)

(73) Assignee: Sandvik Intellectual Property AB, Sandviken (SE)

( * ) Notice: Subject to any disclaimer, the term of this patent is extended or adjusted under 35 U.S.C. 154(b) by 335 days.

(21) Appl. No.: 13/082,560

(22) Filed: Apr. 8, 2011

(65) Prior Publication Data

US 2011/0253821 A1 Oct. 20, 2011

(30) Foreign Application Priority Data

Apr. 16, 2010 (SE) ..... 1050376

(51) Int. Cl.
*B02C 13/26* (2006.01)

(52) U.S. Cl.
USPC ..... 241/101.3; 241/189.1; 241/289

(58) Field of Classification Search
USPC ..... 241/189.1, 287, 289, 290, 101.3
See application file for complete search history.

(56) References Cited

U.S. PATENT DOCUMENTS 4,017,035 A 4/1977 Stuttman
6,070,819 A 6/2000 Young et al.
6,637,680 B1 10/2003 Young et al.

FOREIGN PATENT DOCUMENTS

ES 2289885 A1 2/2008

OTHER PUBLICATIONS

International Search Report from corresponding International application No. PCT/SE2011/050198 dated Jul. 18, 2011; 4 pages.

*Primary Examiner* — Mark Rosenbaum
(74) *Attorney, Agent, or Firm* — Morgan, Lewis & Bockius LLP

(57) ABSTRACT

A horizontal shaft impact crusher includes a crusher housing having an inlet for material to be crushed and an outlet for material that has been crushed. An impeller is mounted in the crusher housing for rotation about a horizontal axis. A curtain disposed in the crusher housing is arranged so material accelerated by the impeller is crushed thereagainst. An adjustment device, which adjusts the position of the curtain relative to the impeller, is slidable connected to guide rods. The adjustment device includes a locking device positionable selectively in either a holding state in which the locking device is de-energized and arranged to apply a holding force for holding the adjustment device in a crusher operation position relative to the guide rods, or an adjustment state in which the locking device is energized and arranged to release the holding force, thereby enabling displacement of the adjustment device relative to the guide rods.

14 Claims, 3 Drawing Sheets

II-II

HORIZONTAL SHAFT IMPACT CRUSHER

RELATED APPLICATION DATA

This application claims priority under 35 U.S.C. §119 and/or §365 to Swedish Patent Application No. 1050376-1, filed Apr. 16, 2010, the entire contents of which are incorporated herein by reference.

TECHNICAL FIELD OF THE INVENTION

The present invention relates to a horizontal shaft impact crusher comprising a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment device for adjusting the position of said curtain relative to the impeller.

BACKGROUND ART

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Horizontal shaft impact crushers are utilized in many applications for crushing hard material, such as pieces of rock, ore etc. A horizontal shaft impact crusher has an impeller that is made to rotate around a horizontal axis. Pieces of rock are fed towards the impeller and are struck by beater elements mounted on the impeller. The pieces of rock are disintegrated by being struck by the beater elements, and are accelerated and thrown against breaker plates, often referred to as curtains, against which further disintegration occurs. The action of the impeller thus causes the material fed to the horizontal shaft impact crusher to move freely in a crushing chamber and to be crushed upon impact against the beater elements, against the curtains, and against other pieces of material moving around at high speed in the crushing chamber.

Adjustment of the position of the curtain may be made to compensate for both curtain wear and beater element wear. Furthermore, adjustment of the position of the curtain can be made to adjust the size of the crushed material.

U.S. Pat. No. 4,017,035 discloses a horizontal shaft impact crusher which is provided with supporting hydraulic cylinders for adjusting and maintaining the position of the curtain.

However, the design of the crusher described in U.S. Pat. No. 4,017,035 is considered to be relatively complex and costly to manufacture and/or operate.

SUMMARY OF THE INVENTION

It is an object of the present invention to provide a simple and robust horizontal shaft impact crusher.

This object is achieved by means of a horizontal shaft impact crusher comprising a crusher housing having an inlet for material to be crushed and an outlet for material that has been crushed. An impeller is mounted in the crusher housing for rotation about a substantially horizontal axis. A curtain is disposed in the crusher housing and arranged so material accelerated by the impeller may be crushed thereagainst. An adjustment device is provided for adjusting the position of the curtain relative to the impeller, and at least two guide rods are disposed in the crusher housing and to which said adjustment device is slidably connected. The adjustment device includes a locking device positionable selectively in either a holding state in which the locking device is de-energized and arranged to apply a holding force for holding the adjustment device in a crusher operation position relative to the guide rods, or an adjustment state in which the locking device is energized and arranged to release the holding force, thereby enabling displacement of the adjustment device relative to the guide rods.

An advantage of this horizontal shaft impact crusher is that the adjustment of the curtains may be carried out in a simple and mechanically stable manner since the adjustment device may be arranged to slide easily along the guide rods when the locking device is energized, i.e. when the locking device operates in its adjustment state. Furthermore, a robust and reliable mounting of the crusher curtains in different positions may be achieved by de-energizing the locking device. By de-energizing is meant relieving hydraulic pressure, pneumatic pressure, electrical power or mechanical force, for example, from the locking device. By energizing is meant applying hydraulic pressure, pneumatic pressure, electrical power or mechanical force, for example. The fact that the locking device is de-energized in the crusher operation position increases reliability, since there is less risk of a failure, caused by any energizing means, during operation of the crusher. Hence, for example, a failure of a hydraulic system, causing loss of hydraulic pressure, would not affect the crusher operation, because no hydraulic pressure is needed in the holding state which is present during crusher operation. Also, curtain adjustments can be carried out quickly and easily without the use of spanners etc. and can be carried out by one person with little or no physical effort. This is advantageous, especially when operating the crusher in recycling operations where oversize material is often fed into the crusher, requiring renewal of the curtain setting in the event of an overload situation.

The locking device may be energized by a power device, such as, e.g., a hydraulic or pneumatic device. Preferably, said power means comprises a hydraulic or pneumatic cylinder. Hence, the locking device may be transferred to its adjustment state in a very robust and easy manner.

Preferably the locking device is arranged to hold said adjustment device, in the holding state, with a predetermined holding force. The adjustment device is movable along said guide rods from the crusher operation position and away from the impeller in response to an excessive force being transferred from the curtain to the adjustment device in excess of the predetermined holding force exerted by the locking device in the holding state. An advantage of this feature is that the adjustment device can slide, in a predictable manner, when exposed to excessive forces even when the locking device is de-energized, i.e. operates in the holding state, such that the curtain is moved away from the impeller. In the holding state of the locking device, the adjustment device is slidable, against the holding force of the locking device, in response to excessive forces caused by, for example, non-crushable objects being inadvertently introduced to the crusher. Hence, a reliable overload protection is achieved.

The locking device preferably comprises a movable locking member which, in said holding state, is pre-tensioned by a resilient element. Hence, the locking device holds the adjustment device in a crusher operation position relative to the guide rods by means of a mechanical retaining means and thus no hydraulic device is needed to retain the curtain in a desired position.

Preferably, the locking device comprises a locking member which is movable between a locking position in which a resilient element applies a retaining force to the locking member, and a non-locking position in which a releasing force exceeding the retaining force of said resilient element and having the opposite direction to the retaining force is applied to the locking member. The resilient element is preferably a spring element in order to provide a simple and robust locking device.

Preferably, the locking member is wedge-shaped.

In one embodiment, the adjustment device further comprises a spring arranged to smoothen the forces exerted on the curtain.

Preferably, the adjustment device further comprises a cross beam to which the curtain is connected, and a hydraulic device which is operative for adjusting the position of the cross beam along the guide rods, in order to aid curtain adjustment. Re-setting of the crusher, e.g. after an overload situation, may thus be made quickly using the hydraulic adjustment system, preferably together with a curtain position reference scale located on the side of the crusher. Hence, the curtain can be re-set to the correct position in an easy manner, thereby enabling production to be resumed quickly and easily.

Preferably, the locking device comprises at least two linear brakes each arranged to clamp a respective one of the guide rods in the holding state, and to release, in the adjustment state, said predetermined holding force upon energization of the respective linear brake by means of a pressurized fluid.

Preferably, the crusher is provided with a curtain position reference scale arranged on the crusher housing. The reference scale ensures that the curtain can be set to a correct position, thereby enabling production to be resumed quickly and easily after for example an overload situation.

These and other aspects of the invention will be apparent from and elucidated with reference to the claims and the embodiments described hereinafter.

BRIEF DESCRIPTION OF THE DRAWING

The invention will hereafter be described in more detail and with reference to the appended drawings.

DETAILED DESCRIPTION

Figure 1:
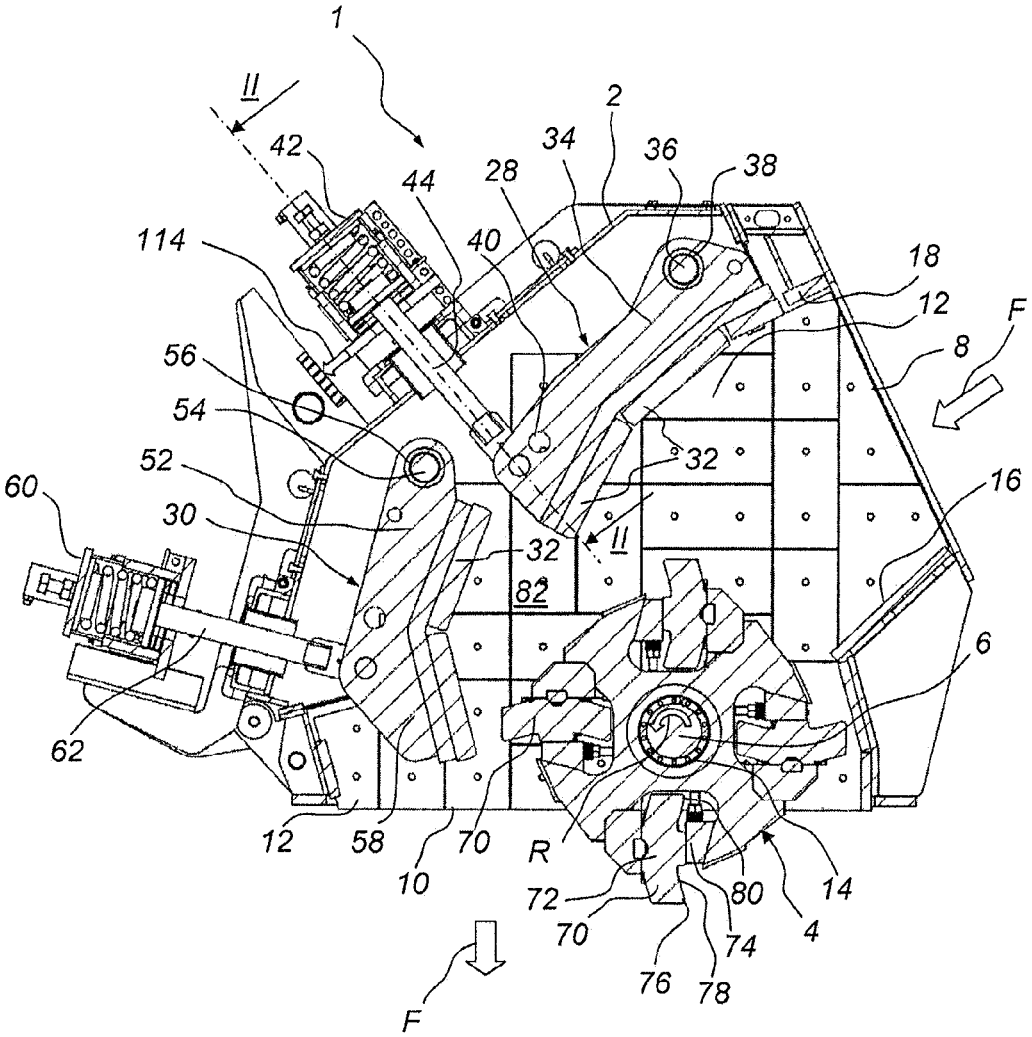
FIG. 1 is a schematic section view taken through a horizontal shaft impact crusher according to an embodiment of the present invention.

FIG. 1 is a cross-section and illustrates, schematically, a horizontal shaft impact crusher 1. The horizontal shaft impact crusher 1 comprises a housing 2 in which an impeller 4 is arranged. A motor, not illustrated for reasons of maintaining clarity of illustration, is operative for rotating a horizontal shaft 6 on which the impeller 4 is mounted. As alternative to the impeller 4 being fixed to the shaft 6, the impeller 4 may rotate around the shaft 6. In either case, the impeller 4 is operative for rotating around a horizontal axis, coinciding with the centre of the horizontal shaft 6.

Material to be crushed is fed to an inlet 8 for material to be crushed. The crushed material leaves the crusher 1 via an outlet 10 for material that has been crushed.

The housing 2 is provided with a plurality of wear protection plates 12 that are operative for protecting the walls of the housing 2 from abrasion and from impact by the material to be crushed. Furthermore, the housing 2 comprises a bearing 14 for the horizontal shaft 6. A lower feed plate 16 and an upper feed plate 18 are arranged at the inlet 8. The feed plates 16, 18 are operative for providing the material fed to the crusher 1 with a suitable direction with respect to the impeller 4.

The crusher 1 comprises a first curtain 28, and a second curtain 30. Each curtain 28, 30 comprises at least one wear plate 32 against which material may be crushed.

A first end 34 of the first curtain 28 has been mounted by means of a horizontal first pivot shaft 36 extending through an opening 38 formed in said curtain 28 at said first end 34. The first pivot shaft 36 extends further through openings in the housing 2 to suspend said first end 34 in said housing 2. A second end 40 of said first curtain 28 is connected to a first adjustment device 42 comprising two parallel adjustment bars 44, of which only one bar 44 is visible in FIG. 1.

A first end 52 of the second curtain 30 has been mounted by means of a horizontal second pivot shaft 54 extending through an opening 56 formed in said curtain 30 at said first end 52. The second pivot shaft 54 extends further through openings in the housing 2 to suspend said first end 52 in said housing 2. A second end 58 of said second curtain 30 is connected to a second adjustment device 60 comprising two parallel adjustment bars 62, of which only one bar 62 is visible in FIG. 1.

The second adjustment device 60 may be of a similar design as the first adjustment device 42, which will be described in more detail hereinafter.

The impeller 4 is provided with four beater elements 70, each such beater element 70 having a "banana" shape, as seen in cross-section. Each beater element 70 has a central portion 72 which is operative for co-operating with a mounting block 74 being operative for pressing the back of the beater element 70 towards the impeller 4 to keep the beater element 70 in position. An arrow R indicates the direction of rotation of the impeller 4. A leading edge 76 of the beater element 70 extends in the direction of rotation R, such that a scoop-area 78 is formed between the central portion 72 and the trailing edge 76. The beater element 70 is symmetric around its central portion 72, such that once the leading edge 76 has been worn out, the beater element 70 can be turned and mounted with its second leading edge 80 operative for crushing material. The area formed between the impeller 4 and the first and second curtains 28, 30 can be called a crushing chamber 82 of the crusher 1.

In operation, material to be crushed is fed to the inlet 8. The material will first reach the first curtain 28, being located upstream of the second curtain 30 as seen with respect to the direction of travel of the material. By means of the feed plates 16, 18 the material is directed towards the impeller 4 rotating at, typically, 400-850 rpm. When the material is hit by the beater elements 70 it will be crushed and accelerated against the wear plates 32 of the first curtain 28 where further crushing occurs. The material will bounce back from the first curtain 28 and will be crushed further against material travelling in the opposite direction and, again, against the beater elements 70. When the material has been crushed to a sufficiently small size, it will move further down the crusher chamber 82, and will be accelerated, by means of the beater elements 70, towards the wear plates 32 of the second curtain 30, being located downstream of the first curtain 28. Hence, the material will move freely around in the crushing chamber 82, and will be crushed against the beater elements 70, against the wear plates 32 of the curtains 28, 30, and against other pieces of material circling around, at a high velocity, in the crusher 1. Arrows F indicate the path of the material moving through the crusher 1.

By adjusting the longitudinal position of the adjustment bar 44 in relation to the housing 2, the first curtain 28 may be pivoted around the first pivot shaft 36 until an optimum distance between the second end 40 and the impeller 4 has been obtained, with respect to the properties, as regards, e.g., size and hardness, of the material to be crushed. Hence, the adjustability of the distance between the first curtain 28 and the impeller 4 is largest at that location, i.e., at the second end 40 of the first curtain 28, where the distance between the first curtain 28 and the impeller 4 is normally the smallest. In a similar manner the second adjustment device 60 may be utilized for making the second curtain 30 pivot around the second pivot shaft 54 until a suitable distance between the impeller 4 and the second end 58 of the second curtain 30 has been obtained.

Figure 2:
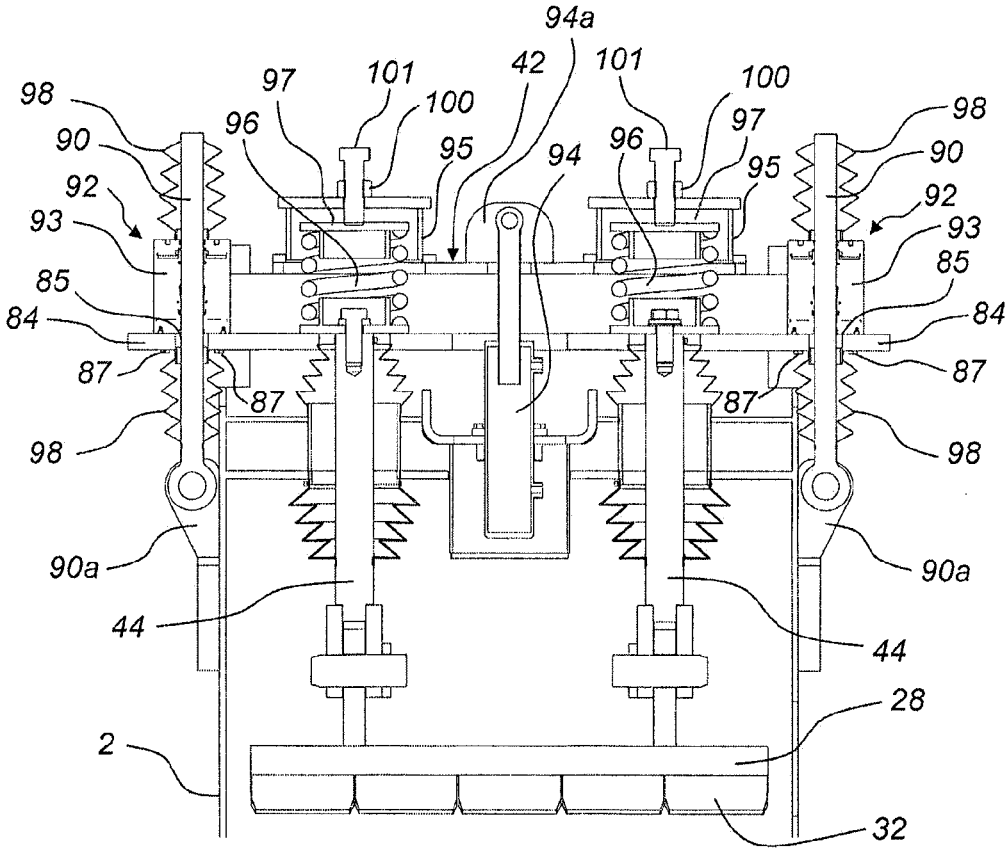
FIG. 2 is a schematic section view taken through the crusher along the line II-II in FIG. 1.

FIG. 2 illustrates the first adjustment device 42 as seen in the direction of the arrows II-II of FIG. 1. The first adjustment device 42 is operative for adjusting the position of the curtain 28 relative to the impeller 4. As illustrated in FIG. 2 the adjustment device 42 comprises a supporting structure, in the form of a cross beam 84, on which the adjustment bars 44 are mounted. The cross beam 84 is provided with two receiving portions 85. Each receiving portion 85 has the shape of an opening that is operative for receiving a guide rod 90, such as a solid steel bar, mounted on the housing 2 by means of brackets 90*a* and extending away from the housing 2. The guide rods 90 provide for lateral guidance of the cross beam 84 and help to prevent the cross beam 84 from twisting during crusher operation and adjustment. The adjustment device 42 is further provided with guide protection, in the form of rubber bellows 98, for protecting the guide rods 90 from dust and particles.

The receiving portions 85 allow the cross beam 84 to move along the guide rods 90. The cross beam 84 is thus slidably connected to the guide rods 90. Adjustment of the cross beam 84, and thereby of the curtain 28 which is connected to the cross beam 84 via the adjustment bars 44, to a correct position with respect to the properties of the material to be crushed may be carried out by displacing the crossbeam 84 relative to the guide rods 90.

The adjustment device 42 is provided with a locking device 92 having a first state or mode of operation, also referred to as a holding state, and a second state or mode of operation, also referred to as an adjustment state. The cross beam 84 is connected to each of the guide rods 90 by means of the locking device 92. In the holding state, the locking device 92 is de-energized and arranged to hold, with a predetermined holding force, the cross beam 84 in a desired crusher operation position relative to the guide rods 90. Hence, the curtain 28 is, in the crusher operation position, held in a desired, and fixed, position relative to the impeller 4, illustrated in FIG. 1. In the adjustment state, the locking device 92 is energized and arranged to release the predetermined holding force. When the locking device 92 is energized, and thus the predetermined holding force is released, displacement of the cross beam 84, and hence of the adjustment device 42, relative to the guide rods 90 is enabled. The locking device 92 may for instance be energized by means of a hydraulic or pneumatic device.

In this embodiment the locking device 92 comprises two linear brakes 93, one linear brake 93 for each rod 90. The linear brakes 93 could, for example, be of the type ROBA®-linearstop supplied from Chr. Mayr GmbH+Co. KG, Germany. The linear brakes 93 are mounted on the cross beam 84 by bolts 87. Since such a linear brake 93 is known per se, it will only be briefly described.

Figure 3:
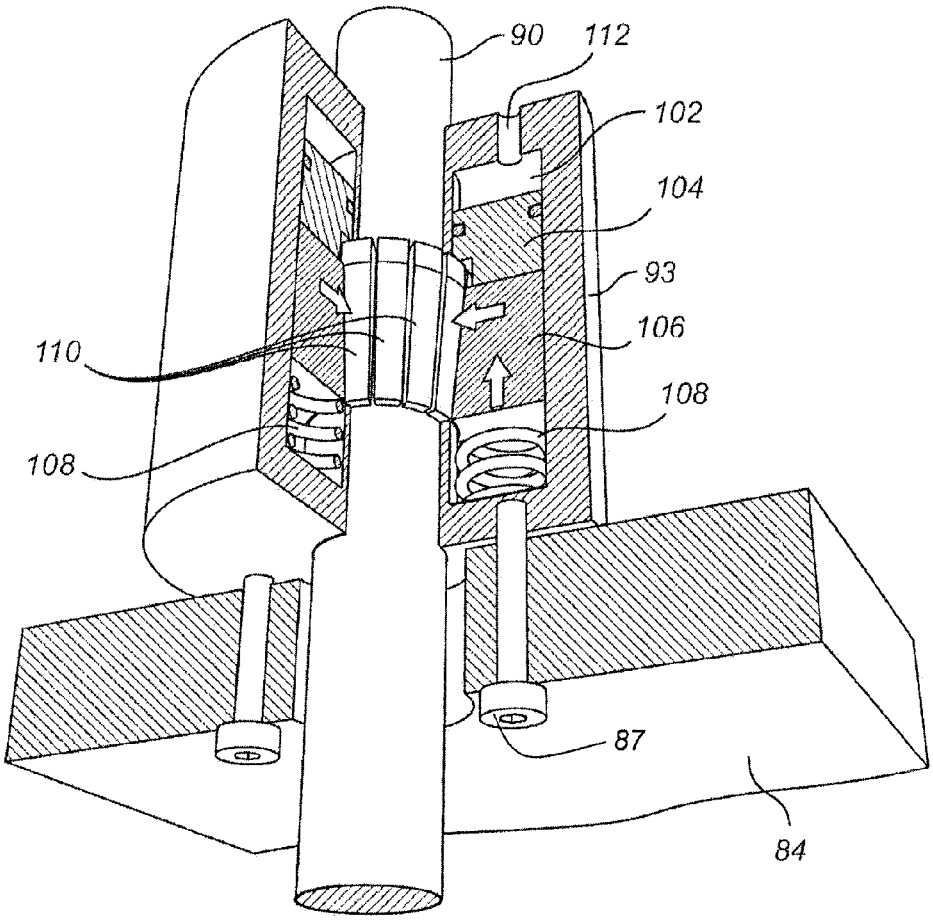
FIG. 3 is a perspective view, partially in section view, illustrating a locking device of the adjustment device shown in FIG. 2.

FIG. 3 illustrates one of the linear brakes 93 in a de-energized state, i.e. when it operates in its holding state. As illustrated in FIG. 3 the linear brake 93 comprises a cavity 102 in which a piston member 104 and a tapered locking member 106 are arranged. The tapered locking member 106 is pre-tensioned by a spring element 108 and executes, via a complementary shaped element 110, a force on the guide rod 90. The force executed on the rod 90 generates a friction force that is large enough to clamp the linear brake 93 to the guide rod 90 so that relative displacement between the rod 90 and the linear brake 93, which is mounted on the cross beam 84, is prevented during normal crushing conditions. The linear brakes 93 clamp the guide rods 90 in an accurate and backlash-free manner via the spring-loading.

The pre-tensioned locking member 106 can be moved, against the force of the spring 108, by energizing the locking device 92 by supplying a pressurized fluid, such as hydraulic oil, air, etc. to the cavity 102 through the hydraulic connection 112. Supplying the pressurized fluid to the chamber 102 will release the holding force, i.e. the friction force that the locking member 106, in co-operation with complementary shaped element 110, generated on the rod 90. Hence, the holding force of the locking device 92 is released. When the holding force is released, adjustment of the position of the cross beam 84 is enabled. Adjustment may be carried out using a hydraulic cylinder, which will be described hereinafter.

After adjusting the cross beam 84 to a desired position, i.e., a position at which the curtain 28 is located at a desired distance from the impeller 4 with respect to the size of the material that is to be crushed, the locking device 92 is de-energized. Such de-energization is carried out by releasing the hydraulic pressure applied to the respective cavity 102 of the linear brakes 93, such that the linear brakes 93 clamp each of the guide rods 90. Such clamping means that a predetermined holding force in the form of the friction force between the elements 110 of the linear brake and the guide rods 90, is generated. This predetermined holding force is large enough to prevent relative displacement between the cross beam 84 and the crusher housing 2 under normal crushing conditions. Hence, the respective locking member 106 is pre-tensioned by the respective spring 108 to a specific tightening force that provides, for each linear brake 93, the desired frictional force between the respective element 110 and the respective guide rod 90. The curtain 28 is thus prevented from pivoting around the first pivot shaft 36 under normal crushing conditions. Hence, hydraulic pressure to the linear brakes 93 is only needed in the adjustment state, and not in the holding state, the holding state being the state in which crusher operation takes place.

If a bulky and non-crushable object is introduced into the crusher 1, the forces exerted on the curtain 28, to which the adjustment device 42 is connected, are raised significantly. Such forces can be denoted excessive forces and are exerted on the cross beam 84 of the adjustment device 42 via the parallel adjustment bars 44. When such excessive forces exceed the predetermined holding force, i.e., the friction force between the elements 110 of the linear brakes 93 and the guide rods 90, the linear brakes 93 of the locking device 92, and thereby of the cross beam 84, slide along the guide rods 90, in a direction away from the impeller 4. That causes the curtain 28 to pivot around the first pivot shaft 36, thereby increasing the distance between the impeller 4 and the curtain 28 such that the non-crushable object can pass through the crusher 1. In this manner damage to parts of the crusher 1 caused by non-crushable objects introduced to the crusher 1 can be avoided.

In the holding state, the cross beam 84 is thus maintained in a desired crusher position by a mechanical spring tensioned locking device 92 comprising the two linear brakes 93. The adjustment device 42 remains slidable, although only when a friction force is overcome, in a predictive way even when the locking device 92 is de-energized and operating in its holding state. If an un-crushable object enters the crusher 1, the locking device 92 allows the cross beam 84 to move relative to the guide rods 90, away from the impeller 4, thus relieving excess pressure on the crusher 1 and curtain 28 without causing damage to parts of the crusher. The locking device 92 thus also works, in addition to being a robust and easy-to-operate device for the adjustment of the position of the curtain 28, as a safety release device when un-crushable objects enter the crusher 1.

The adjustment device 42 further comprises a hydraulic device in the form of a hydraulic cylinder 94 which is mounted on the cross beam 84 and is arranged to aid curtain adjustment. The hydraulic cylinder 94 is, in this embodiment, mounted on the housing 2, and is connected to a bracket 94*a* mounted on the cross beam 84. Hence, by supplying more or less of a hydraulic medium, such as hydraulic oil or pressurised air, to the hydraulic cylinder 94, the distance between the cross beam 84 and the housing 2 may easily be adjusted. Thus, a desired distance is obtained between the impeller 4, which is fixed to the housing 2, and the curtain 28, which is fixed, via the bars 44, to the cross beam 84. This has the advantage that the curtain 28 can be positioned in an easy and safe manner. Once the curtain 28 has reached its correct position, it is locked in place by de-energizing the locking device 92, as described hereinbefore with reference to FIG. 2. After such adjustment of the curtain and the de-energizing of the locking device 92, the pressure in the hydraulic cylinder 94 can be released, such that the hydraulic cylinder 94 does not exert any force between the cross beam 84 and the housing 2. Optionally, a pin or similar device, not shown, connecting the hydraulic cylinder 94 to the bracket 94*a* can be removed, such that the hydraulic cylinder 94 is not in contact with the cross beam 84. Hence, no pressure in the hydraulic cylinder 94 is needed during operation of the crusher 1, and the hydraulic cylinder 94 is inactive during crusher operation. This arrangement ensures that the hydraulic cylinder 94 may be kept under a no-load condition during operation, ensuring that vibration is not transmitted to the hydraulic cylinder 94.

The curtain 28, which is connected to the cross beam 84 of the adjustment device 42, may be repositioned in order to change crusher setting by first energizing the locking device 92 and then displacing the cross beam 84 along the guide rods 90 with the help of the hydraulic cylinder 94 and a curtain position reference scale 114, illustrated in FIG. 1, located on the side of the crusher. The curtain position reference scale 114 comprises a marker, such as an arrow, which is mounted on the cross beam 84, and a scale, which is mounted on the housing 2. The marker points to a position on the scale which corresponds to the current position of the cross beam 84, and, hence, indicates the current position of the curtain 28 relative to the impeller 4. With the help of the curtain position reference scale 114, the cross beam 84, and hence the curtain 28, can easily be adjusted to a desired position after, for example, there occurs a safety release caused by an un-crushable object.

The adjustment device 42 further comprises springs 96, as is best illustrated in FIG. 2, that are pre-tensioned between the cross beam 84 and respective compression plates 97. The springs 96 permit the curtain and the adjusting bars 44 to move relative to the cross beam 84, for smoothening of the forces exerted on the curtain 28 by the material in the crushing chamber 82 during normal crusher operation. The springs 96 are enclosed within a steel cover 95 which ensures the safety of the operator. The position of the compression plates 97 relative to the cross beam 84 can be adjusted by loosening a locknut 100 and a tightening screw 101 in order to adjust the degree of pre-tensioning of the springs 96 and to hence adjust the degree of smoothening of the forces exerted during normal crusher operation.

When material is crushed in the crusher 1, forces are applied to the adjustment device 42 via the curtain 28. As long as the crusher 1 is fed with material of the type that the crusher 1 is designed to crush, the predetermined holding force is not exceeded, which means relative displacement of the adjustment device 42 is prevented. However, it may happen that a non-crushable object of a certain size is introduced into the crusher 1. Such a non-crushable object will exert excessive forces to the curtain 28 and the adjustment device 42. When a force exceeding the predetermined holding force is exerted on the adjustment device 42, the predetermined holding force, i.e. the friction force between the locking device 92 and the guide rods 90 generated by the respective pre-tensioned locking member 106, is no longer strong enough to prevent the adjustment device 42 from sliding along the guide rods 90 away from the housing 2 and away from the impeller 4, such that the curtain 28 is moved away from the impeller 4. Hence, in an overload situation, i.e. when the predetermined holding force is exceeded, displacement of the curtain 28 is enabled, hence avoiding damage to the curtain 28 and the adjustment device 42.

It will be appreciated that numerous modifications of the embodiments described above are possible within the scope of the appended claims.

Hereinbefore, it has been described that the crusher 1 is provided with a first curtain 28, and a second curtain 30 located downstream of the first curtain 28. It will be appreciated that a crusher may also be provided with further curtains, such as a third curtain located downstream of the second curtain. An adjustment device 42 of the type that has been described in detail with reference to FIGS. 2 and 3 can be arranged for one, two, or all of the curtains 28, 30 of a crusher. Hence, the adjustment device 60 being operative for controlling the position of the second curtain 30 could be similar to the adjustment device 42.

In the described embodiment, the adjustment device 42 comprises a hydraulic cylinder 94 for positioning the curtain 28 into a correct position. It is, however, also possible to make the adjustment device entirely mechanical, which may reduce investment and maintenance costs.

In the described embodiment, the locking member 106 is movable between the locking position, in which it is retained by the spring 108, to a non-locking position, to which it is movable against a force from the spring, by supplying pressurized oil or air to the cavity 102. It is however realized that the locking member instead can be moved e.g. by means of an electrically operated solenoid switch or a mechanical lever, operating a cam member to move the locking member 106 and thus compress the spring 108. Hence, pressurized fluids, including liquids and gases, can be used, as well as electrical or mechanical devices, for energization of the locking device 92 to achieve the adjustment state. Other types of locking devices, that are de-energized in a holding state, and energized to achieve an adjustment state, can also be utilized. By de-energization is meant relieving hydraulic pressure, electrical power or mechanical force, as the case may be, and by energization is meant applying hydraulic pressure, electrical power or mechanical force, as the case may be.

In one embodiment a power means in the form of an electrically powered linear actuator is used to move the piston member from its locking position to a non-locking position.

The disclosure of Swedish patent application No. 1050376-1, from which this application claims priority, is incorporated herein by reference.

What is claimed is:

1. A horizontal shaft impact crusher comprising a crusher housing having an inlet for material to be crushed and an outlet for material that has been crushed, an impeller mounted in the crusher housing for rotation about a substantially horizontal axis, a curtain disposed in the crusher housing and arranged so material accelerated by the impeller may be crushed thereagainst, and an adjustment device for adjusting the position of said curtain relative to the impeller, wherein at least two guide rods are disposed in the crusher housing and to which said adjustment device is slidably connected, the adjustment device including a locking device positionable selectively in:

a holding state in which the locking device is de-energized and arranged to apply a holding force for holding said adjustment device in a crusher operation position relative to the guide rods, and an adjustment state in which the locking device is energized and arranged to release the holding force, thereby enabling displacement of the adjustment device relative to the guide rods.

2. The horizontal shaft impact crusher according to claim 1, wherein said locking device comprises a power device arranged to energize said locking device.

3. The horizontal shaft impact crusher according to claim 2, wherein said power device is hydraulically or pneumatically operable.

4. The horizontal shaft impact crusher according to claim 1, wherein in the holding state, the locking device is arranged to yieldably hold said adjustment device to said guide rods in the crusher operating position with a predetermined holding force, while enabling the adjustment device to move along said guide rods away from the crusher operating position and said impeller, in response to an excessive force being transferred from the curtain to the adjustment device which exceeds the predetermined holding force.

5. The horizontal shaft impact crusher according to claim 1, wherein said locking device comprises a movable locking member which, in said holding state, is pre-tensioned by a resilient element.

6. The horizontal shaft impact crusher according to claim 5, wherein said resilient element comprises a spring element.

7. The horizontal shaft impact crusher according to claim 5, wherein said locking member is wedge-shaped.

8. The horizontal shaft impact crusher according to claim 1, wherein said locking device comprises a locking member movable between a locking position in which a retaining force is applied thereto by a resilient element, and a non-locking position in which a releasing force exceeding the retaining force is applied thereto in a direction opposite to the retaining force.

9. The horizontal shaft impact crusher according to claim 8, wherein said resilient element is a spring element.

10. The horizontal shaft impact crusher according to claim 8, wherein said locking member is wedge-shaped.

11. The horizontal shaft impact crusher according to claim 1, wherein the adjustment device comprises a spring arrangement for smoothening forces exerted on the curtain during a crushing operation.

12. The horizontal shaft impact crusher according to claim 1, wherein the adjustment device includes a cross beam to which the curtain is connected, and a hydraulic device for adjusting a position of the cross along the guide rods.

13. The horizontal shaft impact crusher according to claim 1, wherein the locking device comprises at least two linear brakes each arranged to clamp a respective one of said at least two guide rods in the holding state, and to release, in the adjustment state, said holding force upon energization of the respective linear brake by a pressurized fluid.

14. The horizontal shaft impact crusher according to claim 1, further including a curtain position reference device comprising a marker mounted on the adjustment device, and a scale mounted on the crusher housing.

* * * * *